US010472154B2

(12) United States Patent
De La Fé-Dahlin

(10) Patent No.: US 10,472,154 B2
(45) Date of Patent: Nov. 12, 2019

(54) BAG-IN-BOX CONTAINER WITH A PRESSURIZING ELEMENT

(71) Applicant: SWEDBRAND INNOVATIONS LIMITED, Swieqi (MT)

(72) Inventor: Carlos De La Fé-Dahlin, Stockholm (SE)

(73) Assignee: SWEDBRAND INNOVATIONS LIMITED, Triq il-Qasam (MT)

( * ) Notice: Subject to any disclaimer, the term of this patent is extended or adjusted under 35 U.S.C. 154(b) by 0 days.

(21) Appl. No.: 15/735,467

(22) PCT Filed: Jun. 8, 2016

(86) PCT No.: PCT/SE2016/050545
§ 371 (c)(1),
(2) Date: Dec. 11, 2017

(87) PCT Pub. No.: WO2016/200322
PCT Pub. Date: Dec. 15, 2016

(65) Prior Publication Data

US 2018/0155105 A1 Jun. 7, 2018

(30) Foreign Application Priority Data

Jun. 10, 2015 (SE) ..... 1530083

(51) Int. Cl.
*B65D 77/06* (2006.01)
*B65D 83/00* (2006.01)

(52) U.S. Cl.
CPC ..... *B65D 77/065* (2013.01); *B65D 77/06* (2013.01); *B65D 83/0077* (2013.01)

(58) Field of Classification Search
CPC ..... B65D 77/065; B65D 77/00; B65D 77/04; B65D 77/06; B65D 77/062; B65D 83/0077; B65D 83/0055
(Continued)

(56) References Cited

U.S. PATENT DOCUMENTS 3,244,311 A * 4/1966 Lawson ..... B65D 21/0234 206/386
3,938,706 A * 2/1976 Cohen ..... B65D 83/0072 222/83.5
(Continued)

FOREIGN PATENT DOCUMENTS

WO 2006068586 A1 6/2006
WO 2007084054 A1 7/2007
(Continued)

OTHER PUBLICATIONS

International Search Report for PCT/SE2016/050545 dated Aug. 16, 2016.
(Continued)

*Primary Examiner* — Kareen K Thomas
(74) *Attorney, Agent, or Firm* — Moore & Van Allen PLLC; W. Kevin Ransom

(57) ABSTRACT

A bag-in-box container is provided with a spout at an upper opening and a pressurizing element applying pressure to a flexible container. The pressurizing element includes two plate devices being urged apart by a resilient element. The two plate devices are provided with engageable hook elements that may be set out of engagement by shifting one of the plate devices with respect to the other along the plane of the plate devices; the shift causing all hooks to disengage simultaneously. This shifting apart action is performed from the side of the pressurizing element, facilitating disengagement from the side of the bag-in-box container. In one embodiment, a disengagement port is provided giving access to the pressurizing element, such that the at least two plate devices may be brought out of engagement with each other. The disengagement port may be a second opening on the side of the rigid casing.

4 Claims, 4 Drawing Sheets

(58) Field of Classification Search
USPC ..... 220/495.01–495.11
See application file for complete search history.

(56) References Cited

U.S. PATENT DOCUMENTS 3,997,072 A * 12/1976 Guth ..... B65F 1/06 220/324
4,223,808 A 9/1980 Williams et al.
4,321,922 A * 3/1982 Deaton ..... A61M 1/0001 220/319
4,379,455 A * 4/1983 Deaton ..... A61M 1/0001 220/319
4,459,793 A * 7/1984 Zenger ..... B65D 25/18 220/495.04
4,858,781 A * 8/1989 Kane ..... B65F 1/062 220/495.07
4,984,713 A * 1/1991 Chambers ..... B65D 23/00 215/12.1
4,996,760 A * 3/1991 Coleman ..... B65D 77/061 220/495.05
5,265,755 A * 11/1993 McArthur, Jr. ..... B65F 1/068 220/369
5,405,000 A * 4/1995 Hagedon ..... B65D 81/075 206/216
8,146,762 B2 * 4/2012 Leoncavallo ..... A61J 1/16 206/508
2005/0215961 A1 * 9/2005 Romano ..... A61M 1/0001 604/322
2008/0257447 A1 * 10/2008 Mauger ..... B65B 69/0075 141/2
2011/0068126 A1 * 3/2011 Walter ..... B67D 3/0029 222/146.1

FOREIGN PATENT DOCUMENTS

WO 2010043226 A1 4/2010
WO 2012051185 A1 4/2012
WO 2015021015 A1 2/2015

OTHER PUBLICATIONS

Written Opinion of the International Searching Authority for PCT/SE2016/050545 dated Aug. 15, 2016.
Swedbrand Innovations Limited, European Application No. 16807919.2, Extended European Search Report, dated Mar. 20, 2019.

* cited by examiner

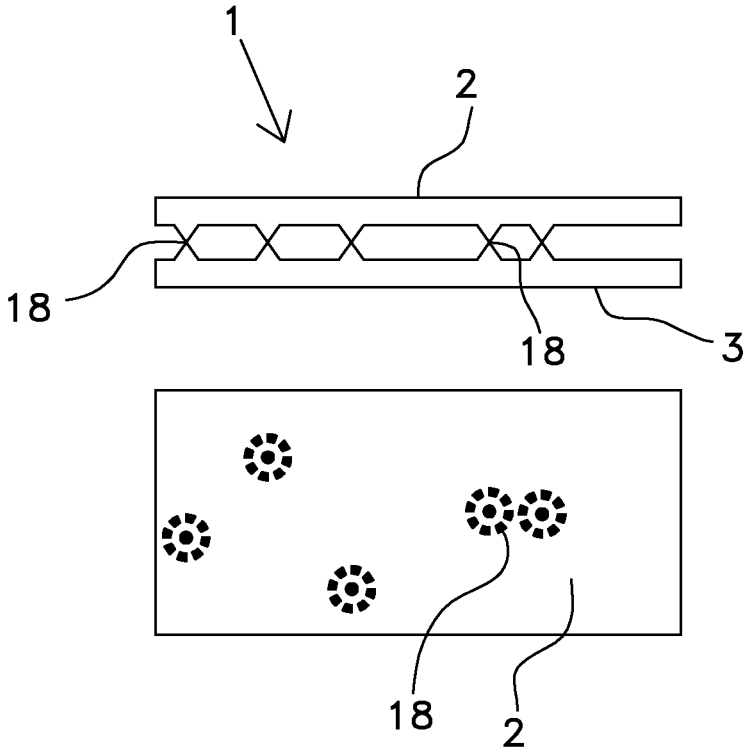
Fig. 1A
Fig. 1B
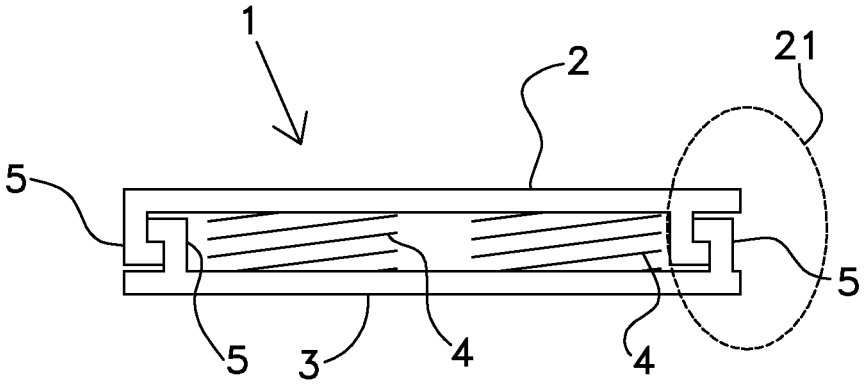
Fig. 2

BAG-IN-BOX CONTAINER WITH A PRESSURIZING ELEMENT

CROSS-REFERENCE TO RELATED APPLICATION(S)

This application is a national stage application (filed under 35 § U.S.C. 371) of PCT/SE2016/050545, filed Jun. 8, 2016 of the same title, which, in turn claims priority to Swedish Application No. 1530083-3, filed Jun. 10, 2015 of the same title; the contents of each of which are hereby incorporated by reference.

FIELD OF THE INVENTION

The present invention relates to a bag-in-box container with a flexible container element-enclosed in a rigid casing, with a pressurizing element.

BACKGROUND OF THE INVENTION

Bag-in-box containers are typically provided with a spout positioned near the bottom of the container, making it impossible to fill a glass from the spout if the container is set in any other position than at the edge of a table. Bag-in-box containers provided with a spout positioned near the top of the container are known, such as the one disclosed by WO2007084054. It contains a spring loaded element that pressurizes the liquid held in a flexible bag inside the bag-in-box container, making it possible to empty its contents through the top spout.

In order to prevent that the contents of such a bag-in-box container is constantly under pressure, making it prone to leaking and sensitive to further pressure from the exterior during storage and transport, the pressurizing element is provided with a lock. The pressurizing element does not apply pressure the flexible bag when in a locked state. The lock may be unlocked through an access at the bottom of the bag-in-box container. Once released, the pressurizing element may easily rise asymmetrically and get stuck at an angle, and this of highly undesirable.

An object of the invention is therefore to provide a bag-in-box container which has an unlocking procedure that reduces the risk that the pressurizing element may easily rise asymmetrically and get stuck at an angle.

SUMMARY OF THE INVENTION

The invention relates to a bag-in-box container comprising a flexible container element 7 enclosed in a rigid casing 8, where the bag-in-box container is provided with an upper opening 14 for an outlet connected to the flexible container element 7. The upper opening 14 is being arranged above the middle on a side of the bag-in-box container. The bag-in-box container is further provided with a pressurizing element 1-5, 11 which is arranged to apply pressure to the flexible container element 7. The pressurizing element 1-5, 11 is constituted at least by two plate devices 2-3, 5 being urged apart by at least one resilient element 4. The at least two plate devices 2-3, 5 are provided with engageable hook elements 5 that may be set out of engagement by shifting one of the plate devices with respect to the other essentially along the plane of the plate devices. In performing this shift, all hooks disengage simultaneously, advantageously allowing the plate devices to move apart in a direction being orthogonal to the plane in which they extend. This shifting apart action is advantageously preferably performed from the side of the pressurizing element, facilitating disengagement from the side of the bag-in-box container.

The bag-in-box according preferably comprises an disengagement port 6 giving access to the pressurizing element 1-5, 11 in such a fashion that the at least by two plate devices 2-3, 5 may be brought out of engagement with each other through action on the disengagement port 6. Most advantageously, the disengagement port 6 is constituted by a second opening on the side of the rigid casing 8 positioned at the side of the pressurizing element 1-5, 11.

BRIEF DESCRIPTION OF THE DRAWINGS

Provided below is a brief description of the various drawings:

FIG. 1A shows a schematic illustration of a first embodiment of a spring-loaded plate element as seen from the side in cross section;

FIG. 1B shows a schematic illustration of the first embodiment of the spring-loaded plate element as seen from the side in partial cross section;

FIG. 2 shows a second embodiment of a spring-loaded plate element as seen from the side in cross section;

DETAILED DESCRIPTION OF THE INVENTION

Figure 3A:
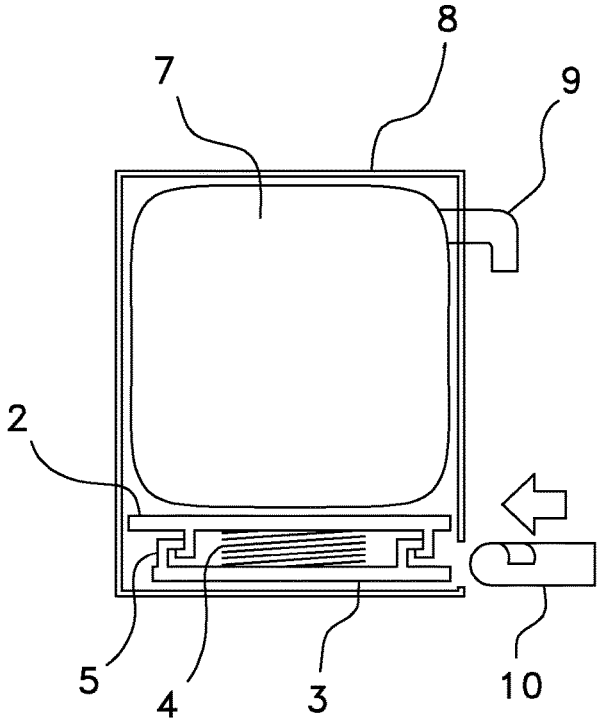
FIG. 3A shows a first embodiment of a bag-in-box container as seen from the side in cross section, where the spring-loaded plate element is in a passive state.

The invention refers to a spring-loaded plate element for use with a bag-in-box container and it refers to a bag-in-box container with such a spring-loaded plate element. The invention is now described with reference thirteen figures illustrating four embodiments of the spring-loaded plate elements and three embodiments of bag-in-box container with such a spring-loaded plate element FIG. 1A shows a schematic illustration of a first embodiment of a spring-loaded plate element 1 as seen from the side in cross section and FIG. 1B shows a schematic illustration of the first embodiment of the spring-loaded plate element as seen from the side in partial cross section. The spring-loaded plate element 1 is constituted by a first plate device 2 and a second plate device 3. The plate devices are constituted by essentially flat elements with five locking elements 18. A not illustrated spring is held in a gap between the plate devices, and the loaded spring acts to push the plate elements apart, while they are prevented from separating from each other by the locking elements 18, and as long as the locking elements are joined together, the spring-loaded plate element is in a passive state. In the passive state, the spring-loaded plate element 1 does not apply force to surrounding elements.

As described in greater detail below, the locking elements may be brought out of the locked stated, and the spring will then urge the plate devices apart. While the lower plate element remains held in place against the bottom of the bag-in-box container, the upper plate element will move upwards inside the bag-in-box container. If the locking elements are not released simultaneously, there is a significant risk that the upper plate element will end up no longer being parallel to the lower plate element and it may then get stuck in an angled position between the inner walls of the bag-in-box container casing. As the locking elements on each plate and the corresponding plate may be produced as a solid element, the locking elements may conveniently be freely arranged at suitable positions 18 such that they are released simultaneously.

Even though the locking elements are released simultaneously, if the force applied by the springs is not symmetrically disposed around the centre of gravity of the spring-loaded plate element, the action of the springs themselves may urge the upper plate element to get stuck at an angle inside the bag-in-box container casing. A single spring centred at the centre of gravity of the spring-loaded plate element would eliminate that factor, but a more practical solution is to use more than one spring, so as an example a distribution of five springs corresponding to the distribution of five locking elements at the locking positions 18 in the figure would mitigate the risk of the upper plate element to get stuck at an angle.

FIG. 2 shows a second embodiment of a spring-loaded plate element 1 as seen from the side in cross section. It is illustrated in a locked state, where the locking elements 5 of the upper plate element 2 are engaged with the locking elements 5 of the lower plate element 3. The upper and lower plate elements are embodied as plates of even thickness, with locking elements 5 extending from the plates. The locking elements 5 have a neck extending at an orthogonal angle from each plate, and from the end of the necks furthest away from the surface of the plate, a grasping part is arranged, that extends in parallel to the plate. The grasping part of each locking element of the lower plate elements grasps a corresponding grasping part of a locking element on the upper plate. As the grasping parts of the locking elements of the upper plate element all face what in the figure is right 21, and the grasping parts of the locking elements of the lower plate element all face what in the figure is left, shifting the upper plate element to the left with respect to the lower plate element, will bring the grasping parts out of engagement with each other. The locking elements are arranged in such a fashion, that all locking elements will be brought out of the locking state simultaneously when the two plates as shifted away from each other. Two springs 4 arranged in the gap between the plate elements will then be free to urge the two plate elements apart.

FIG. 3A shows a first embodiment of a bag-in-box container as seen from the side in cross section, where the spring-loaded plate element 2-5 is in a passive state, that is not applying pressure on surrounding elements. The bag-in-box container is embodied as a relatively rigid rectilinear casing 8 holding a liquid impermeable bag 7 with a spout 9 extending through and opening in the casing. The opening in the casing with the spout is positioned near the top surface of the casing, such that a glass may be conveniently positioned under the spout even if the bag-in-box container is placed in a table top.

The spring-loaded plate element 2-5 is arranged below the liquid impermeable bag 7, and access to the spring-loaded plate element is available through a lower opening 6 in the casing. The two plate devices of the spring-loaded plate element may be separated using a finger 10 through the lower opening. The two plate devices of the spring-loaded plate element are of different widths, where the upper one reaches from side to side of the casing, preventing it from moving, while the lower one is somewhat narrower, allowing it to be shifted towards the left inner wall of the casing.

Figure 3B:
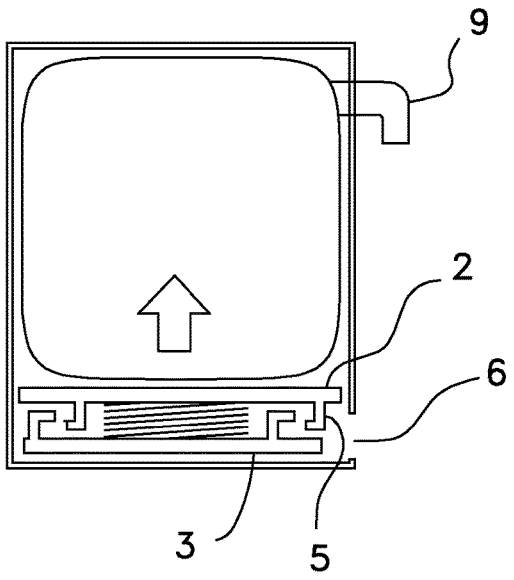
FIG. 3B shows the first embodiment of a bag-in-box container as seen from the side in cross section, where the spring-loaded plate element is in an active state.

FIG. 3B shows the first embodiment of a bag-in-box container as seen from the side in cross section, where the spring-loaded plate element is in an active state, that is applying pressure on the liquid impermeable bag 7. The two plate devices of the spring-loaded plate element have now been separated out of the locked state, so that the pressure of the spring acts in the liquid in the liquid impermeable bag, allowing its contents to be poured out of the spout 9.

Figure 4:
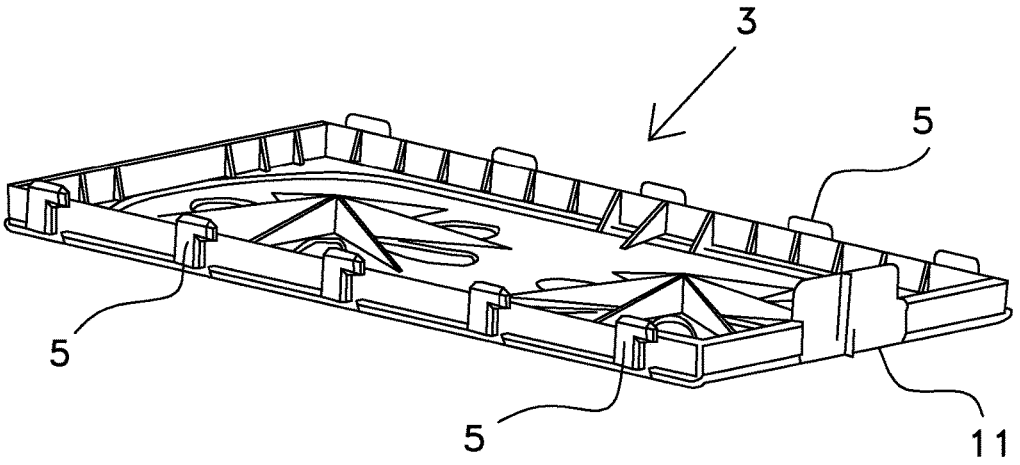
FIG. 4 shows a first plate device of a fourth embodiment of the spring-loaded plate element as seen at an angle from above.

FIG. 4 shows a first plate device 3 of a fourth embodiment of the spring-loaded plate element as seen at an angle from above. The fourth embodiment of the spring-loaded plate element refers to a realistic design, while the previous embodiments are intended as simplistic illustrations of the principle behind the invention. The first plate device is constituted by a flat plate with an edge rim extending upwards along the edges of the flat plate. The rim acts to hold the first and second plate devices apart a distance sufficient to allow springs to be arranged between them. The rim does in conjunction with other rigidizing elements also make the plate device more rigid than it would have been without these elements, making it possible to keep its weight and volume low. As the springs are tensioned, they tend to expand radially, so the rim also keep them in place.

Along the edge of the first plate device facing the viewer five locking elements are arranged, and along the edge of the first plate device facing away from the viewer five further locking elements are arranged. They are embodied essentially as in the second embodiment illustrated in FIG. 2, with grasping parts directed to the right. On the right side of the first plate device, the plate device is provided with a pushing pad 11 for pushing the plate devices apart from each other.

Figure 5:
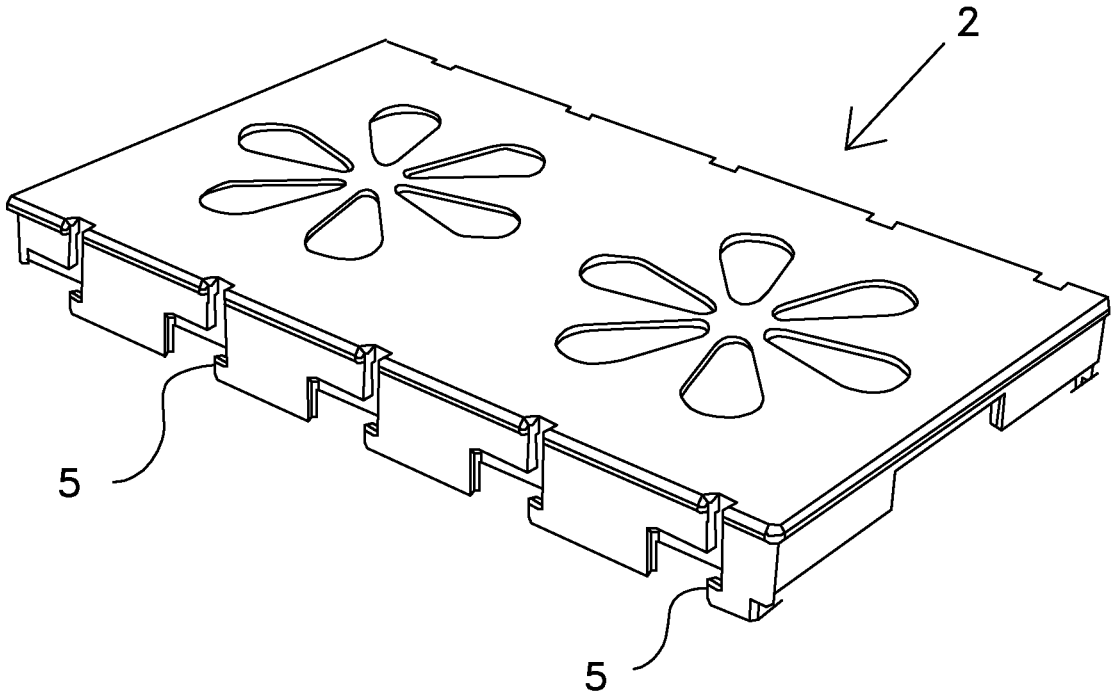
FIG. 5 shows a second plate device of the fourth embodiment of the spring-loaded plate element as seen at an angle from above.

FIG. 5 shows a second plate device of the fourth embodiment of the spring-loaded plate element as seen at an angle from above, designed for engaging the first plate device 3 of the fourth embodiment. It is in a similar fashion constituted by a flat plate with an edge rim extending downwards along the edges of the flat plate. The rim engages the rim of the first plate device, keeping them apart a distance sufficient to allow springs to be arranged between them. The rim also acts in conjunction with other rigidizing elements on second plate device to make the plate device more rigid than it would have been without these elements.

The rim is provided with recesses that may receive the locking elements of the first plate device, and the recesses are shaped such that they provide locking elements 5. Along the edge of the second plate device facing the viewer, five locking elements are arranged, and along the edge of the second plate device facing away from the viewer five further locking elements are arranged. They are embodied essentially as in the second embodiment illustrated in FIG. 2, but with grasping parts directed to the left.

Figure 6:
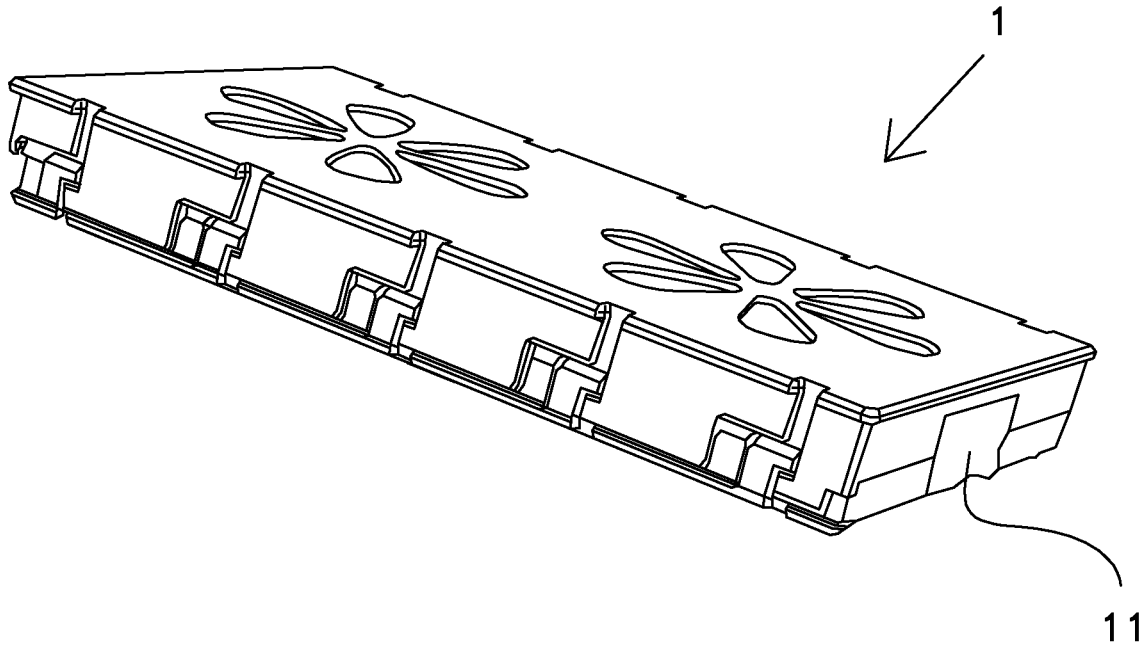
FIG. 6 shows the first and second plate devices of the fourth embodiment joined together as seen at an angle from above.

FIG. 6 shows the first and second plate devices of the fourth embodiment joined together as seen at an angle from above. As seen from the figure, the upper second plate device extends further in a left-to-right direction that the lower first plated device, such that the upper second plate precisely fits inside the casing and is held in place there. The second plate device is therefore held firm when put an a bag-in-box container, so pushing against the pushing pad 11 will separate the two plate devices of the spring-loaded plate element 1 out of the locked state.

Figure 7A:
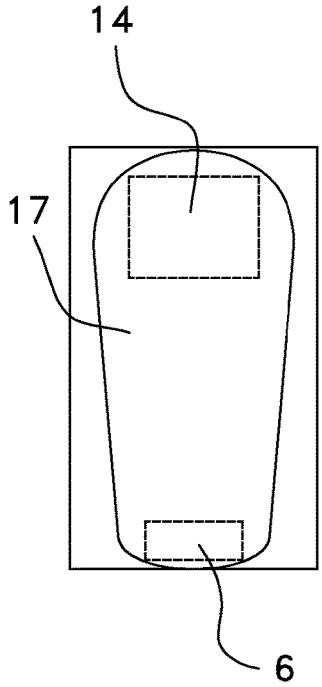
FIG. 7A shows a second embodiment of a bag-in-box container in a fully closed state as seen from the front side in partial cross section.

FIG. 7A shows a second embodiment of a bag-in-box container in a fully closed state as seen from the front side in partial cross section. The front side is provided with an upper 14 and a lower opening 6, hidden from view by a label element 17. The label element thus prevents access to the spout and prevents access for unlocking the spring-loaded plate element.

Figure 7B:
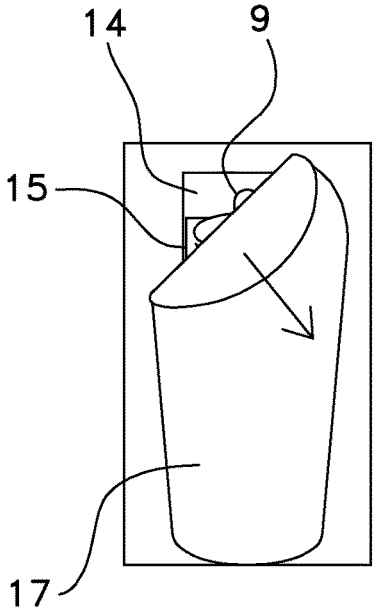
FIG. 7B shows the second embodiment of the bag-in-box container in a first step of the opening procedure as seen from the front side.

FIG. 7B shows the second embodiment of the bag-in-box container in a first step of the opening procedure as seen from the front side, and here the label element 17 has been removed from the top portion of the front side of the bag-in-box container, partially revealing the spout 9 arranged on a board 15 attached along its lower rim 16 to the bag-in-box container casing.

Figure 7C:
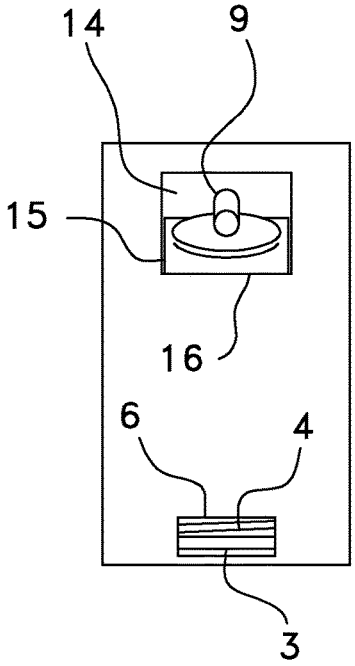
FIG. 7C shows the second embodiment of the bag-in-box container in a second step of the opening procedure as seen from the front side.

FIG. 7C shows the second embodiment of the bag-in-box container in a second step of the opening procedure as seen from the front side, where the label element 17 has been fully removed from the top portion of the front side of the bag-in-box container, fully revealing the upper 14 and the lower openings 6. Access to the spring-loaded plate element 3-4 is now granted through the lower opening 6, making the bag-in-box container ready for use.

The denotation spring-loaded plate element obviously does not constitute a restriction in the protective scope, but is merely a convenient denotation that in a simplistic manner describes the constitution of the arrangement as disclosed by the presented embodiments. Clearly, the element embodied as one or several springs 4 may alternatively be embodied as other resilient elements such as a pressurized pneumatic cylinder or a gas-filled balloon. What these resilient elements have in common is that they strive to displace the two plate devices away from each other, but allows compression to such an extent that the plate elements may be locked together into a spring-loaded plate element.

In a corresponding fashion, the denotation bag-in-box container obviously does not constitute a restriction in the protective scope but is merely a convenient denotation that refers to a common application of the invention. A bag-in-box container is constituted by any flexible or malleable container for a liquid, such as a liquid impermeable bag, contained in an external casing. The external casing is in comparison with the flexible container rigid.

The invention claimed is:

1. A bag-in-box container comprising a flexible container element enclosed in a rigid casing; where the bag-in-box container is provided with an upper opening for an outlet connected to the flexible container element, the upper opening being arranged above a middle and on a side of the bag-in-box container, where the bag-in-box container further is provided with a pressurizing element which is arranged to apply pressure to the flexible container element, wherein the pressurizing element is constituted by at least two plate devices being urged apart by at least one resilient element, wherein the at least two plate devices are provided with engageable hook elements being arranged to be set out of engagement by shifting one of the plate devices with respect to the other essentially along a plane of the plate devices.

2. A bag-in-box according to claim 1, further comprising a disengagement port giving access to the pressurizing element, such that the at least two plate devices are arranged to be brought out of engagement with each other through action applied to the disengagement port.

3. A bag-in-box according to claim 2, wherein the disengagement port is constituted by a second opening on a side of the rigid casing positioned at a side of the pressurizing element.

4. A bag-in-box according to claim 1, wherein a first of the at least two plate devices has a width corresponding to an inner width of the rigid casing, while a second of the at least two plate devices has a narrower width than that of the first of the at least two plate devices.

* * * * *